US011392057B2

(12) United States Patent
Kamoshida et al.

(10) Patent No.: US 11,392,057 B2
(45) Date of Patent: Jul. 19, 2022

(54) DEVELOPING APPARATUS HAVING A FLEXIBLE DEVELOPER CONVEYOR

(71) Applicant: CANON KABUSHIKI KAISHA, Tokyo (JP)

(72) Inventors: Shigemi Kamoshida, Kanagawa (JP); Yosuke Kashiide, Tokyo (JP); Shohei Katsuya, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/338,800

(22) Filed: Jun. 4, 2021

(65) Prior Publication Data

US 2021/0389693 A1 Dec. 16, 2021

(30) Foreign Application Priority Data

Jun. 12, 2020 (JP) ..... JP2020-102663

(51) Int. Cl.
*G03G 15/08* (2006.01)

(52) U.S. Cl.
CPC ..... *G03G 15/0881* (2013.01); *G03G 15/0882* (2013.01); *G03G 15/0889* (2013.01); *G03G 15/0891* (2013.01); *G03G 15/0894* (2013.01); *G03G 2215/0687* (2013.01); *G03G 2215/085* (2013.01)

(58) Field of Classification Search
CPC ..... G03G 15/0881; G03G 15/0891; G03G 15/0882; G03G 15/0889; G03G 15/0894; G03G 2215/085; G03G 2215/0687
See application file for complete search history.

(56) References Cited

U.S. PATENT DOCUMENTS

| | | | |
|---|---|---|---|
| 9,195,170 | B2 | 11/2015 | Batori |
| 9,477,180 | B2 | 10/2016 | Fukuta et al. |
| 9,785,090 | B2 | 10/2017 | Shirakata |
| 10,168,641 | B2 | 1/2019 | Shirakata |
| 10,915,060 | B2 | 2/2021 | Kawai et al. |

(Continued)

FOREIGN PATENT DOCUMENTS

| | | |
|---|---|---|
| JP | 2015-011229 A | 1/2015 |
| JP | 2015-028594 A | 2/2015 |

(Continued)

*Primary Examiner* — Walter L Lindsay, Jr.
*Assistant Examiner* — Laura Roth
(74) *Attorney, Agent, or Firm* — Venable LLP

(57) ABSTRACT

A developing apparatus includes a developer conveyance member including a rotatably supported flexible sheet having a first distance between its rotation axis and an edge of the flexible sheet in a state where the flexible sheet is unbent. A lid of a developing container includes a corner portion that extends a storage space outward of an imaginary circle with a radius of the first distance centered on the rotational axis, and a contact portion which protrudes from an inner surface of the corner portion to an inner side of the imaginary circle and with which the flexible sheet contacts while the conveyance member is being rotated. The contact portion has a distal edge shaped such that a distance between the distal edge and the rotation axis increases toward a downstream side in a rotation direction of the conveyance member as viewed in the direction along the rotation axis.

9 Claims, 13 Drawing Sheets

(56) References Cited

U.S. PATENT DOCUMENTS

| | | | | |
|---|---|---|---|---|
| 2006/0204284 | A1* | 9/2006 | Kawakami | G03G 15/0877 399/262 |
| 2015/0192881 | A1* | 7/2015 | Fukuta | G03G 15/0889 399/254 |
| 2016/0062270 | A1* | 3/2016 | Fukasawa | G03G 15/0889 399/106 |
| 2017/0357184 | A1 | 12/2017 | Shirakata | |
| 2019/0302691 | A1* | 10/2019 | Kawahito | G03G 15/0875 |
| 2021/0055672 | A1* | 2/2021 | Sunahara | G03G 15/0872 |
| 2021/0124304 | A1 | 4/2021 | Kawai et al. | |

FOREIGN PATENT DOCUMENTS

| | | | |
|---|---|---|---|
| JP | 2015-129812 | A | 7/2015 |
| JP | 2015-163944 | A | 9/2015 |

* cited by examiner

DEVELOPING APPARATUS HAVING A FLEXIBLE DEVELOPER CONVEYOR

BACKGROUND OF THE INVENTION

Field of the Invention

The present invention relates to a developing apparatus to be used in an electrophotographic image forming apparatus.

Description of the Related Art

In an image forming apparatus that uses an electrophotographic image forming method, developer is typically stored in a developer container and successively supplied to a developing apparatus. The developer is typically conveyed from the developer container to the developing apparatus by using a rotational agitation member, which includes a flexible agitation sheet.

The agitation member is supported inside the developer container. As the agitation member rotates, the flexible agitation sheet may transition repeatedly between a state, in which the agitation sheet is in contact with the frame of the developer container and is thus bent, and a state, in which the agitation sheet is separate from the frame and released from bending. The difference between bent state and release state can be great especially with a downsized developer container, thus increasing the fatigue of the agitation sheet. In this respect, Japanese Patent Application Publication No. 2015-129812 describes a configuration including ribs that come into contact with the agitation sheet to prevent the release noise generated when the sheet is released.

SUMMARY OF THE INVENTION

The present invention further improves conventional techniques, and it is an object of the present invention to provide a developing apparatus that is downsized and has an increased capacity but still suppresses the fatigue of agitation sheets.

To achieve the above objective, a developing apparatus according to the present invention includes:

a developing container having a first opening and a second opening;

a lid fixed to the developing container so as to close the first opening, the lid defining, together with the developing container, a storage space for developer;

a developing roller provided so as to face the second opening; and a conveyance member configured to convey a toner toward the developing roller through the second opening in the developing container, the conveyance member including a flexible sheet and a support member that supports the sheet and is rotatable about a rotation axis together with the sheet, the sheet having a first distance between the rotation axis and an edge of the sheet in a direction orthogonal to the rotation axis in a state in which the sheet is unbent, wherein the lid includes:

a corner portion that, as viewed in a direction along the rotation axis, extends the storage space outward of an imaginary circle with a radius of the first distance centered on the rotational axis; and a contact portion that protrudes from the corner portion to an inner side of the imaginary circle and is configured to come into contact with the rotating sheet.

As described above, the present invention provides a developing apparatus that is downsized and has an increased capacity but still suppresses the fatigue of agitation sheets.

Further features of the present invention will become apparent from the following description of exemplary embodiments with reference to the attached drawings.

DESCRIPTION OF THE EMBODIMENTS

Figure 1:
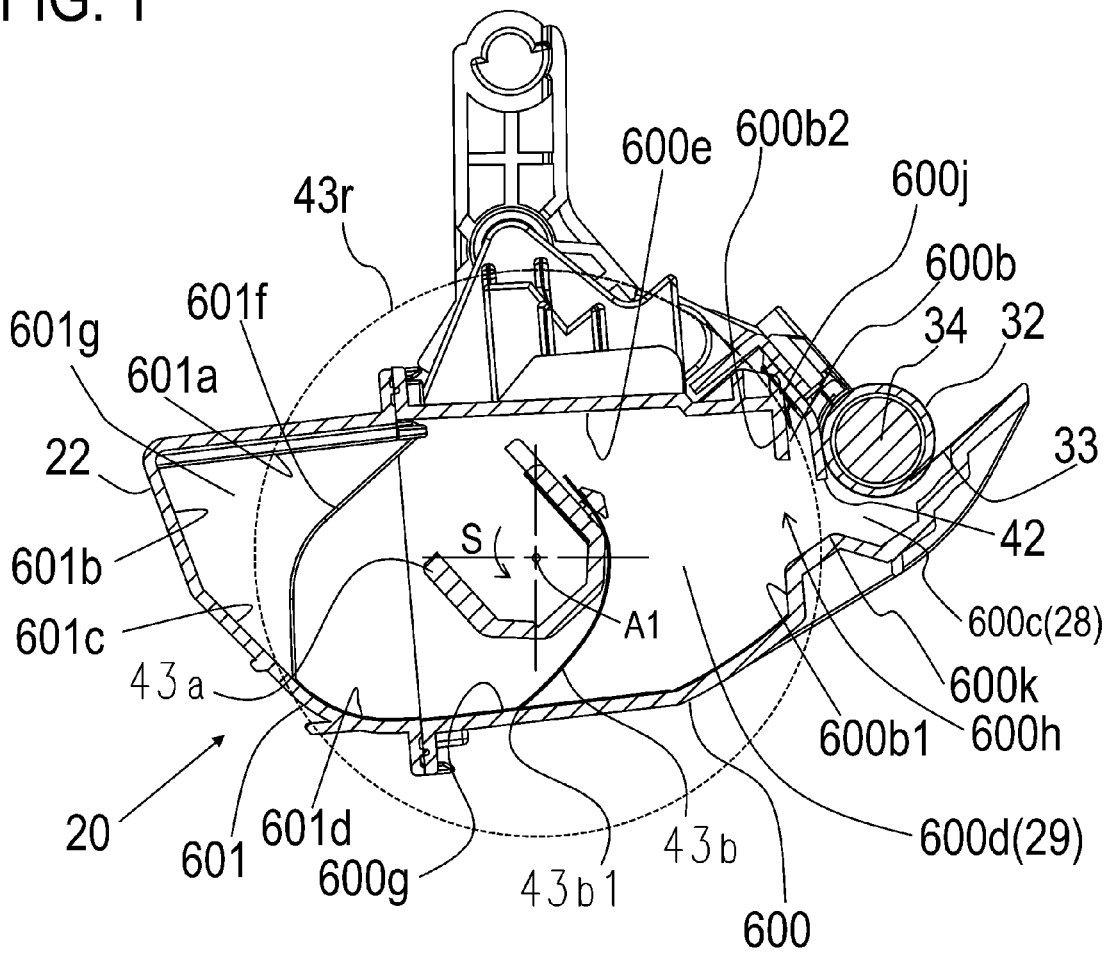
FIG. 1 is a cross-sectional view of the principal section of a developing unit.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Referring to the drawings, an embodiment of the present invention is now described.

A direction along the rotation axis of the electrophotographic photosensitive drum is referred to as a longitudinal direction. In the longitudinal direction, the side in which the electrophotographic photosensitive drum receives driving force from the image forming apparatus main body is referred to as a drive side, and the opposite side is referred to as a non-drive side.

Figure 2:
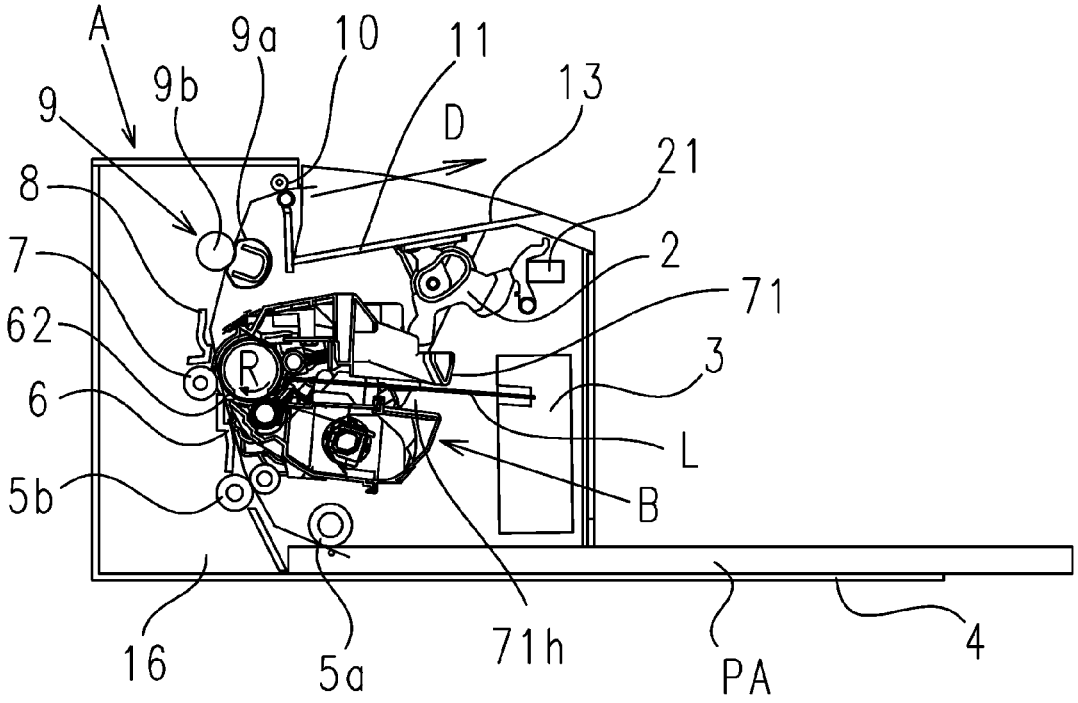
FIG. 2 is a cross-sectional view of an apparatus main body and a cartridge of an image forming apparatus.
Figure 3:
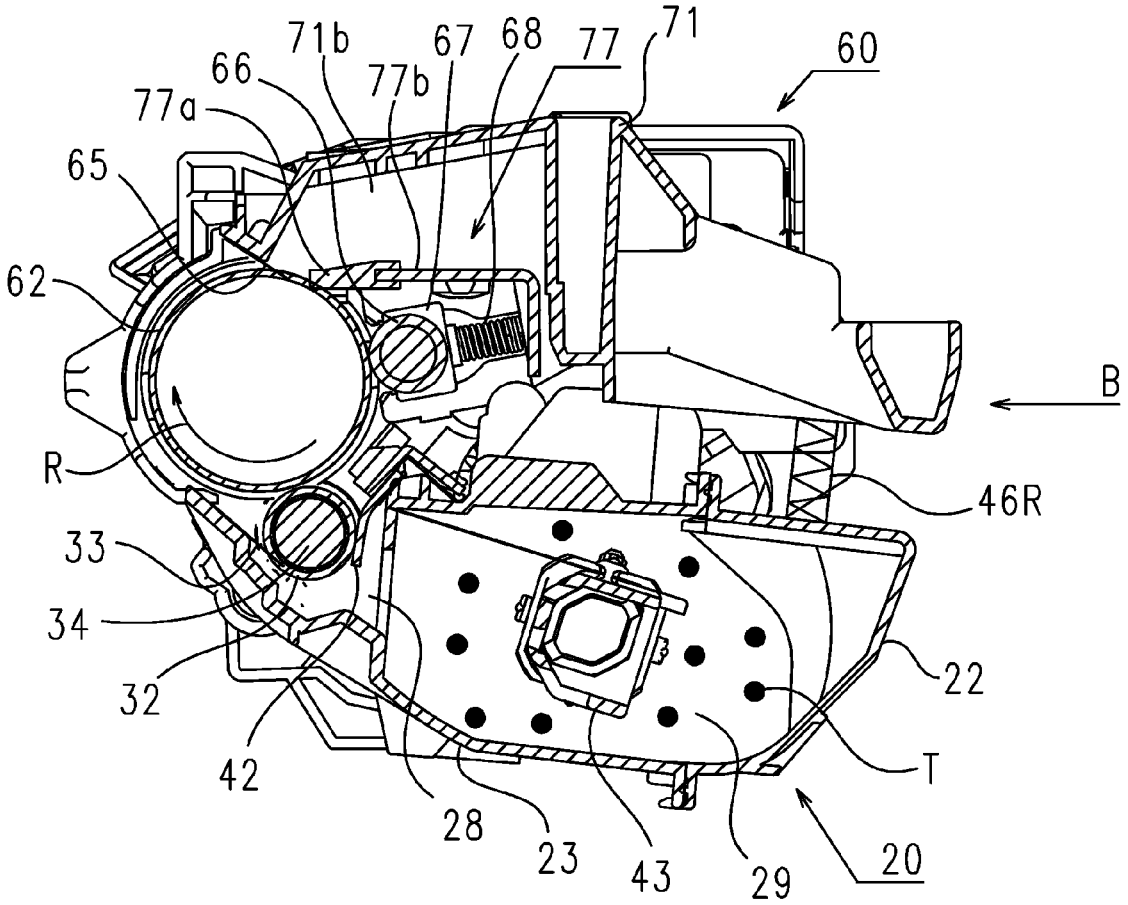
FIG. 3 is a cross-sectional view of the cartridge.

Referring to FIGS. 2 and 3, the overall configuration and an image formation process are now described. FIG. 2 is a cross-sectional view of an apparatus main body (electrophotographic image forming apparatus main body, image forming apparatus main body) A and a process cartridge (hereinafter referred to as a cartridge B) of the electrophotographic image forming apparatus according to the embodiment of the present invention. FIG. 3 is a cross-sectional view of the cartridge B. The apparatus main body A is a portion of the electrophotographic image forming apparatus excluding the cartridge B.

Overall Configuration of Electrophotographic Image Forming Apparatus

The electrophotographic image forming apparatus (image forming apparatus) shown in FIG. 2 is a laser beam printer using an electrophotographic technique in which the cartridge B is attached to the apparatus main body A in a detachable manner. When the cartridge B is attached to the apparatus main body A, an exposure apparatus 3 (laser scanner unit) is arranged that forms latent images on an electrophotographic photosensitive drum 62, which serves as an image bearing member of the cartridge B. A sheet tray 4, which is arranged under the cartridge B, stores recording medium such as recording paper or plastic sheet (hereinafter referred to as sheet material PA) on which images are formed. The electrophotographic photosensitive drum 62 is a photosensitive member (electrophotographic photosensitive member) used to form electrophotographic images.

The apparatus main body A further includes a pickup roller 5*a*, a pair of feeding rollers 5*b*, a transfer guide 6, a transfer roller 7, a conveyance guide 8, a fixing apparatus 9, a pair of discharge rollers 10, and a discharge tray 11, which are arranged along the conveying direction D of the sheet material PA. The fixing apparatus 9 includes a heating roller 9*a* and a pressing roller 9*b*.

Image Formation Process

The outline of the image formation process is now described. In response to a print start signal, the electrophotographic photosensitive drum (hereinafter, referred to as photosensitive drum 62 or simply as drum 62) is driven to rotate in the arrow R direction at a predetermined circumferential speed (process speed). A charging roller (charging member) 66, to which a bias voltage is applied, is in contact with the outer circumferential surface of the drum 62 and uniformly charges the outer circumferential surface of the drum 62 (see FIG. 3).

The exposure apparatus 3 outputs a laser beam L according to image information. The laser beam L passes through the laser opening 71*h* provided in a cleaning frame 71 of the cartridge B, and scans the outer circumferential surface of the drum 62 to perform exposure. An electrostatic latent image corresponding to the image information is thus formed on the outer circumferential surface of the drum 62.

As shown in FIG. 3, a developing unit 20, which serves as the developing apparatus, includes a toner chamber 29 storing toner T. A conveyance member (agitation member) 43 rotates to agitate and convey the toner T to a toner supply chamber 28. The magnetic force of a magnet roller 34 (stationary magnet) holds the toner T on the surface of a developing roller 32. The developing roller 32 is a developer carrying member that carries developer (toner T) on its surface to develop the latent image formed on the drum 62. A developing blade 42 friction-charges the toner T and controls the layer thickness of the toner T on the circumferential surface of the developing roller 32, which serves as the developer carrying member.

The toner T is supplied to the drum 62 according to the electrostatic latent image to develop the latent image. As a result, the latent image is formed as a visible toner image. The drum 62 is an image bearing member that bears a latent image or an image to be formed with toner (toner image, developer image) on its surface. As shown in FIG. 2, the sheet material PA stored in a lower portion of the apparatus main body A is sent out from the sheet tray 4 by the pickup roller 5*a* and the pair of feeding rollers 5*b* in time with the output of a laser beam L. The sheet material PA is conveyed along the transfer guide 6 to the transfer position between the drum 62 and the transfer roller 7. At this transfer position, the toner image is sequentially transferred from the drum 62 to the sheet material PA.

The sheet material PA to which the toner image is transferred is conveyed away from the drum 62 and to the fixing apparatus 9 along the conveyance guide 8. The sheet material PA then passes through the nip portion of the heating roller 9*a* and the pressing roller 9*b* of the fixing apparatus 9. The fixing process of pressing and heating at the nip portion fixes the toner image on the sheet material PA. The sheet material PA that has undergone the toner image fixing process is conveyed to the pair of discharge rollers 10 and discharged to the discharge tray 11.

As shown in FIG. 3, the residual toner on the outer circumferential surface of the drum 62 after transferring is removed by a cleaning member 77 and used for an image formation process again. The toner removed from the drum 62 is stored in a waste toner chamber 71*b* of a cleaning unit 60. The cleaning unit 60 is a photosensitive drum unit including the photosensitive drum 62.

In the foregoing description, the charging roller 66, the developing roller 32, the transfer roller 7, and the cleaning member 77 function as a process unit for acting on the drum 62.

Overall Cartridge Configuration

Figure 4:
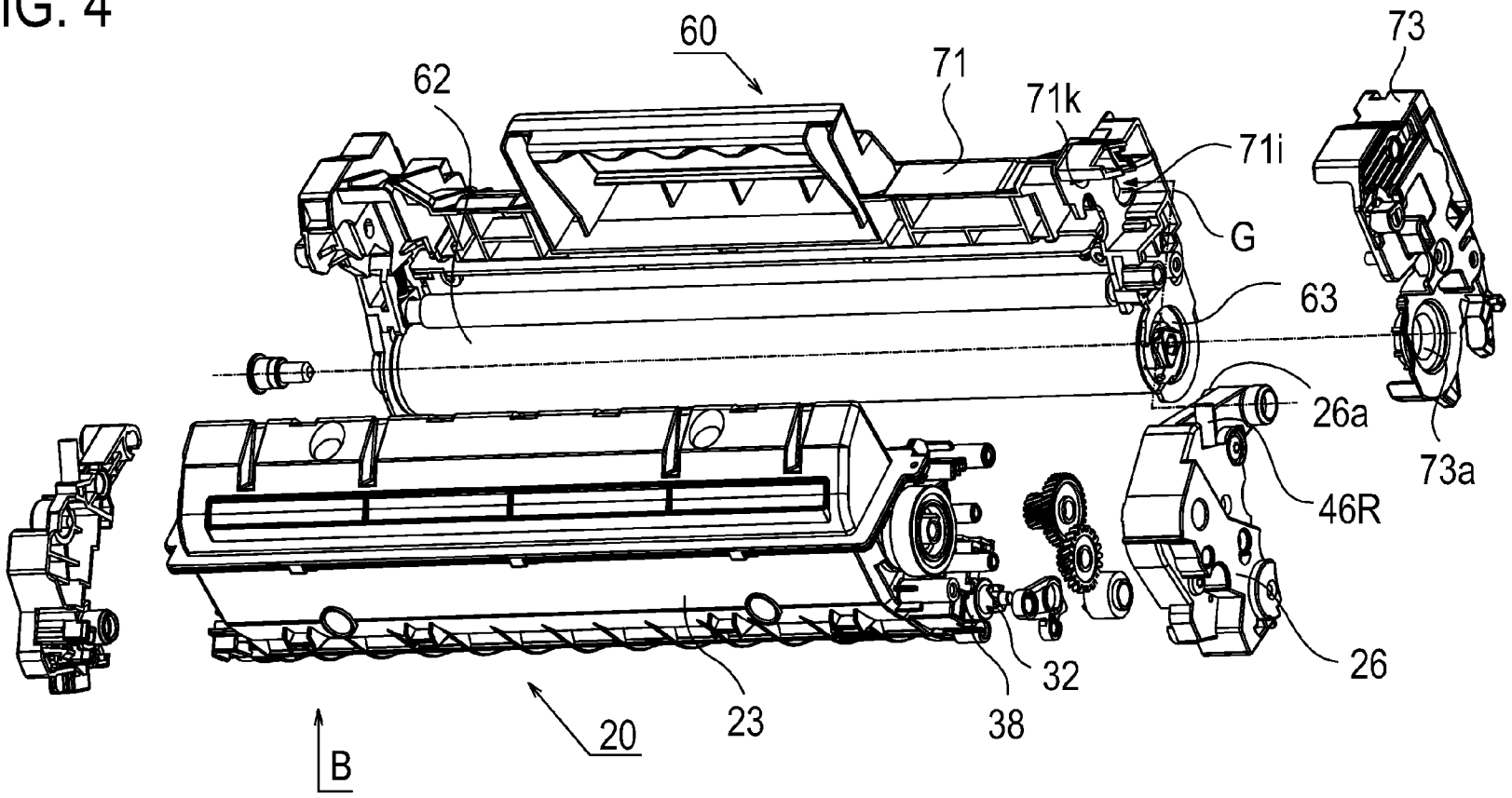
FIG. 4 is a perspective view illustrating the configuration of the cartridge.
Figure 5:
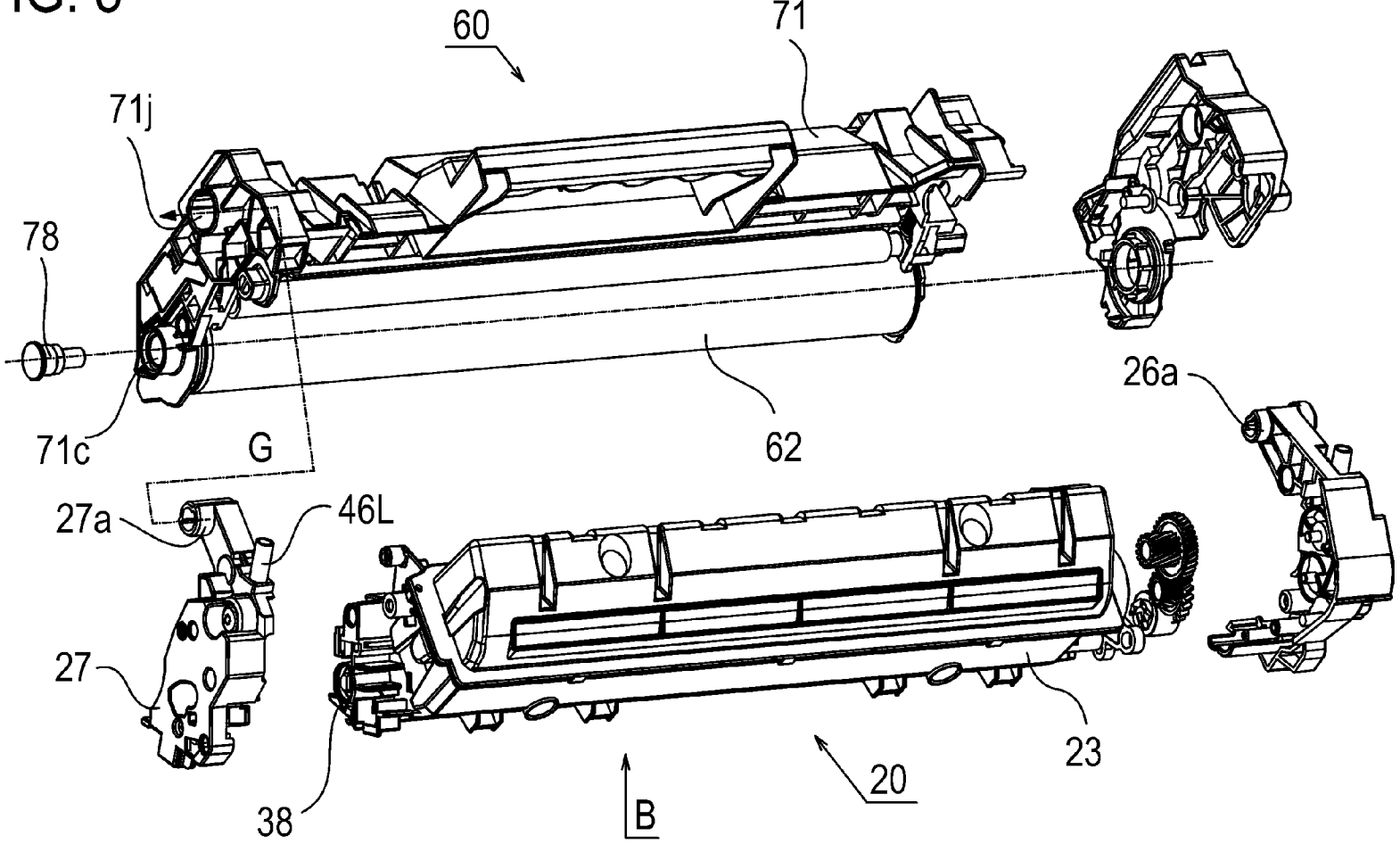
FIG. 5 is a perspective view illustrating the configuration of the cartridge.

Referring to FIGS. 3, 4, and 5, the overall configuration of the cartridge B is now described. FIG. 3 is a cross-sectional view of the cartridge B, and FIGS. 4 and 5 are perspective views illustrating the configuration of the cartridge B. In this embodiment, the description of the screws for connecting parts is omitted.

The cartridge B includes the cleaning unit (photosensitive member holding unit, drum holding unit, image bearing member holding unit, first unit) 60 and the developing unit (developer carrying member holding unit, second unit) 20.

As shown in FIG. 3, the cleaning unit 60 includes the drum 62, the charging roller 66, the cleaning member 77, and a cleaning frame 71, which supports these components. On the drive side, the drum 62 includes a drive-side drum flange 63, which is rotationally supported by a hole portion 73*a* of a drum bearing 73 (see FIG. 4). In a broad sense, the drum bearing 73 and the cleaning frame 71 can be collectively referred to as a cleaning frame.

As shown in FIG. 5, on the non-drive side, a drum shaft 78 is press-fitted into a hole portion 71*c* formed in the cleaning frame 71 so that a hole portion (not shown) of the non-drive-side drum flange is rotationally supported. The drum flanges are portions that are rotationally borne and supported by the respective bearing portions.

As shown in FIG. 3, the charging roller 66 and the cleaning member 77 of the cleaning unit 60 are in contact with the outer circumferential surface of the drum 62.

The cleaning member 77 has a rubber blade 77*a*, which is a blade-shaped elastic member made of rubber as an elastic material, and a support member 77*b* supporting the rubber blade. The rubber blade 77*a* substantially extends in the direction opposite to the rotation direction of the drum 62 and is in contact with the drum 62. That is, the rubber blade 77*a* is in contact with the drum 62 with its distal edge portion pointing toward the upstream side in the rotation direction R of the drum 62. The waste toner removed from the surface of the drum 62 by the cleaning member 77 is stored in the waste toner chamber 71*b* defined by the cleaning frame 71 and the cleaning member 77.

As shown in FIG. 3, a scooping sheet 65 for preventing waste toner from leaking from the cleaning frame 71 is provided at an edge of the cleaning frame 71 in contact with the drum 62.

The charging roller 66 is rotationally attached to the cleaning unit 60 through charging roller bearings 67 located at opposite ends in the longitudinal direction of the cleaning frame 71. The longitudinal direction of the cleaning frame 71 (the longitudinal direction of the cartridge B) is substantially parallel to the direction in which the rotation axis of the drum 62 extends (axial direction). Hereinafter, the longitudinal direction and the axial direction therefore refer to the axial direction of the drum 62 unless otherwise specified.

Urging members 68 press the charging roller bearings 67 toward the drum 62, thereby pressing the charging roller 66 against the drum 62. The charging roller 66 is driven and rotated by the rotation of the drum 62.

As shown in FIG. 3, the developing unit 20 includes the developing roller 32, a developing container 600 supporting the developing roller 32, and a developing blade 42. The developing roller 32 is rotationally attached to the developing container 600 through bearing members 26 (FIG. 4) and 27 (FIG. 5) provided at opposite ends.

The developing roller 32 contains the magnet roller 34. The developing unit 20 includes the developing blade 42 for controlling the toner layer on the developing roller 32. As shown in FIGS. 4 and 5, spacing members 38 are attached to opposite ends of the developing roller 32. The spacing members 38 are brought into contact with the drum 62, so that the developing roller 32 is held with a small gap created between the developing roller 32 and the drum 62. As shown in FIG. 3, a spout prevention sheet 33 for preventing the toner from leaking from the developing unit 20 is provided at an edge of the developing container 600 and in contact with the developing roller 32. A conveyance member 43 is provided in the toner chamber 29 defined by the developing container 600 and a lid 601. The conveyance member 43 agitates the toner stored in the toner chamber 29 and conveys the toner to the toner supply chamber 28.

As shown in FIGS. 4 and 5, the cartridge B is formed by combining the cleaning unit 60 and the developing unit 20. To join the developing unit 20 to the cleaning unit 60, the center of a first developing-side support boss 26*a* of the bearing member 26 is aligned with a first suspension hole 71*i* on the drive side of the cleaning frame 71, and the center of a second developing-side support boss 27*a* of the bearing member 27 is aligned with a second suspension hole 71*j* on the non-drive side. Specifically, the developing unit 20 is moved in the direction of arrow G so that the first and second developing-side support bosses 26*a* and 27*a* are fitted into the first and second suspension holes 71*i* and 71*j*. The developing unit 20 is thus movably connected to the cleaning unit 60. Specifically, the developing unit 20 is rotationally (pivotally) connected to the cleaning unit 60. That is, the developing roller 32 is coupled to the drum 62 so as to be movable toward and away from the drum 62. Then, the drum bearing 73 is coupled to the cleaning unit 60 to form the cartridge B.

In this embodiment, a non-drive-side urging member 46L (FIG. 5) and a drive-side urging member 46R (FIG. 4) are compression springs. The urging force of the springs allows the drive-side urging member 46R and the non-drive-side urging member 46L to urge the developing unit 20 to the cleaning unit 60, ensuring that the developing roller 32 is pressed in the direction of the drum 62. The present embodiment also includes the spacing members 38 at opposite ends of the developing roller 32. That is, the drum 62 is in contact with the developing roller 32 through the spacing members 38 with a predetermined contact pressure, so that the developing roller 32 is held with a predetermined gap created between the developing roller 32 and the drum 62. The relative positions of these components are thus determined.

Cartridge Attachment

Figure 6A:
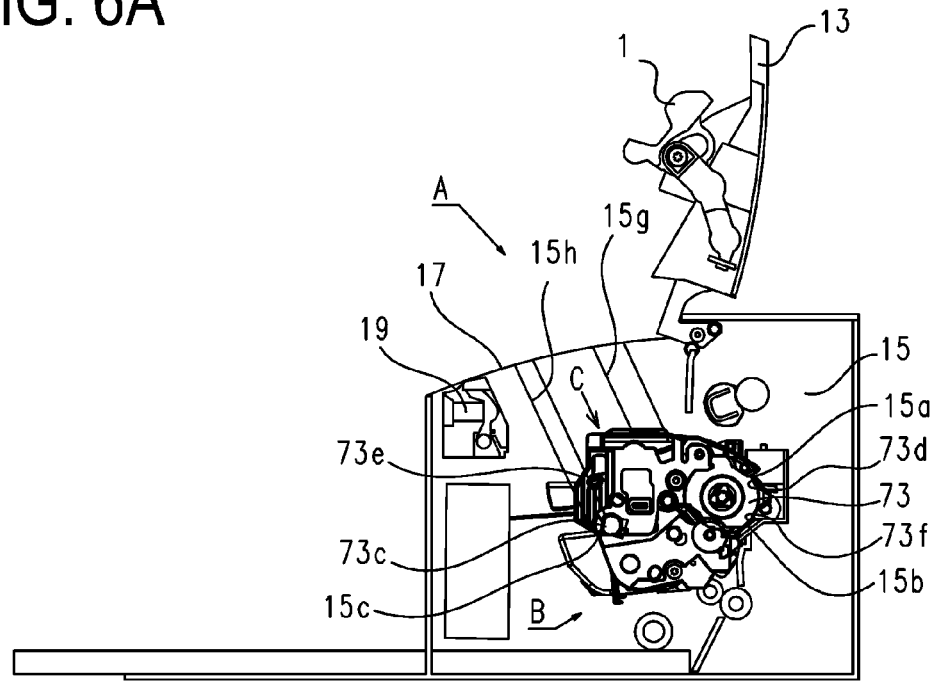
FIGS. 6A and 6B are cross-sectional views of guide portions of the image forming apparatus for illustrating the attachment of the cartridge.
Figure 6B:
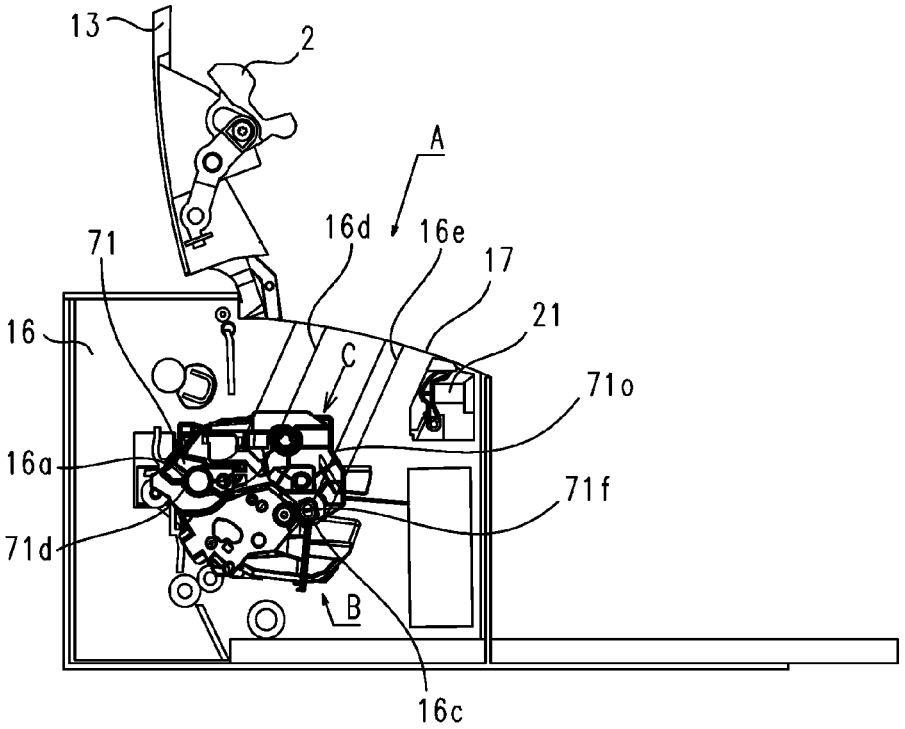
Figure 7A:
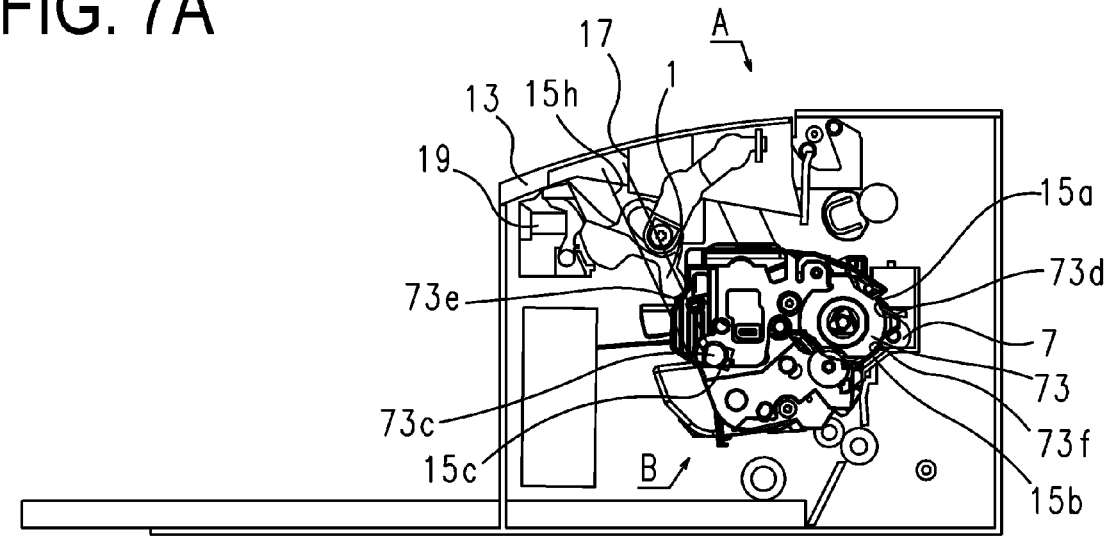
FIGS. 7A and 7B are cross-sectional views of the image forming apparatus for illustrating the positioning of the cartridge.
Figure 7B:
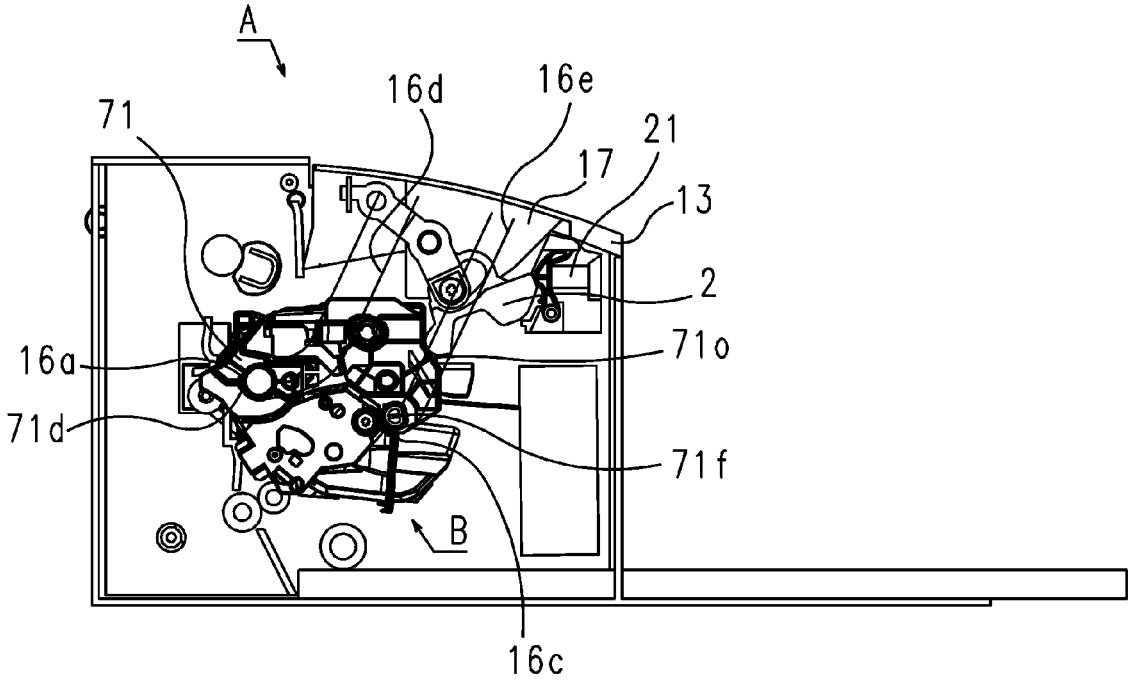

Referring to FIGS. 6A, 6B, 7A, and 7B, the attachment of the cartridge B is now described in detail. FIG. 6A is a cross-sectional view of the drive-side guide portion of the image forming apparatus A for illustrating the attachment of the cartridge B. FIG. 6B is a cross-sectional view of the non-drive-side guide portion of the image forming apparatus A for illustrating the attachment of the cartridge B. FIG. 7A is a cross-sectional view of the drive side of the image forming apparatus A for illustrating the positioning of the cartridge B. FIG. 7B is a cross-sectional view of the non-drive side of the image forming apparatus A for illustrating the positioning of the cartridge B.

The cartridge B is attached as follows. As shown in FIGS. 6A and 6B, a first drive-side plate 15 includes an upper guide rail 15*g* and a guide rail 15*h* as guides, and a non-drive-side plate 16 includes a guide rail 16*d* and a guide rail 16*e*. The drum bearing 73 provided on the drive side of the cartridge B has a rotation stop target portion 73*c*. The cartridge B is attached in a direction (arrow C) substantially perpendicular to the axis of the drum 62 (FIG. 3).

The cleaning frame 71 includes, on the non-drive side in the longitudinal direction, a positioning target portion 71*d* as a first positioning portion and a rotation stop target portion 71*f* as a second positioning portion. When the cartridge B is attached through a cartridge insertion slot 17 of the apparatus main body A, the guide rail 15*h* of the apparatus main body A guides the rotation stop target portion 73*c* of the cartridge B on the drive side of the cartridge B. On the non-drive side of the cartridge B, the guide rails 16*d* and 16*e* of the apparatus main body A guide the positioning target portion 71*d* and the rotation stop target portion 71*f* of the cartridge B. The cartridge B is thus attached to the apparatus main body A.

The closing of an opening/closing door 13 is now described. As shown in FIGS. 6A, 6B, 7A, and 7B, the first drive-side plate 15 has an upper positioning portion 15*a*, a lower positioning portion 15*b*, and a rotation stop portion 15*c* as positioning portions, and the non-drive-side plate 16 has a positioning portion 16*a* and a rotation stop portion 16*c*. The drum bearing 73 includes a positioning target portion (first positioning target portion, first protrusion, first bulging portion) 73*d* and a positioning target portion (second positioning target portion, second protrusion, second bulging portion) 73*f*.

Cartridge pressing members 1 and 2 are rotationally attached to opposite axial ends of the opening/closing door 13. Cartridge pressing springs 19 and 21 are attached to the longitudinal ends of the front plate of the image forming apparatus A. The drum bearing 73 has a pressing target portion 73*e* as an urging force receiving portion, and the cleaning frame 71 has a pressing target portion 710 on the non-drive side (see FIG. 3). When the opening/closing door 13 is closed, the cartridge pressing members 1 and 2 urged by the cartridge pressing springs 19 and 21 of the apparatus main body A press the pressing target portions 73*e* and 710 of the cartridge B (see FIGS. 7A and 7B).

As a result, on the drive side, the upper positioning target portion 73*d*, the lower positioning target portion 73*f*, and the rotation stop target portion 73*c* of the cartridge B are fixed to the upper positioning portion 15*a*, the lower positioning portion 15*b*, and the rotation stop portion 15*c*, respectively, of the apparatus main body A. The cartridge B and the drum 62 are thus positioned on the drive side. Likewise, on the non-drive side, the positioning target portion 71*d* and the rotation stop target portion 71*f* of the cartridge B are fixed to the positioning portion 16*a* and the rotation stop portion 16*c*, respectively, of the apparatus main body A. The cartridge B and the drum 62 are thus positioned on the non-drive side.

The above description of an example of the configuration for positioning the cartridge B relative to the apparatus main body A is not intended to limit the means for positioning. A configuration may be used that directly acts on the positioning target portion 73*d* and the rotation stop target portion 73*f* on the drive side of the cartridge B, and the positioning target portion 71*d* and the rotation stop target portion 71*f* on the non-drive side to fix the positioning portions.

Figure 8A:
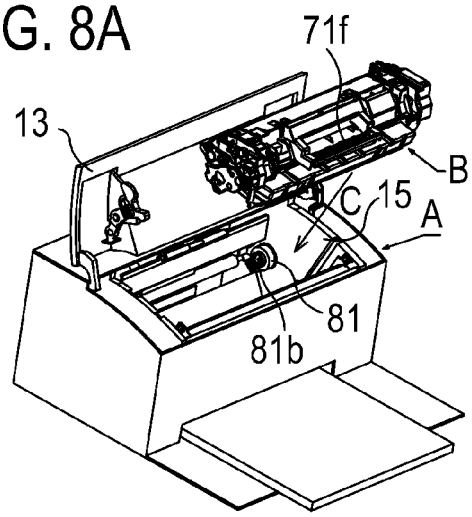
FIGS. 8A to 8D are perspective views illustrating a configuration in which the cartridge receives driving force from the apparatus main body.
Figure 8B:
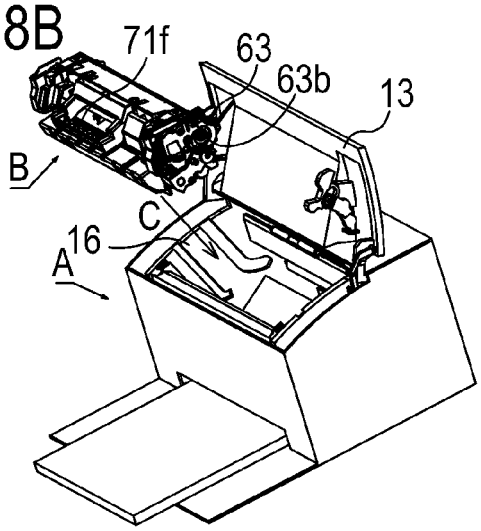
Figure 8C:
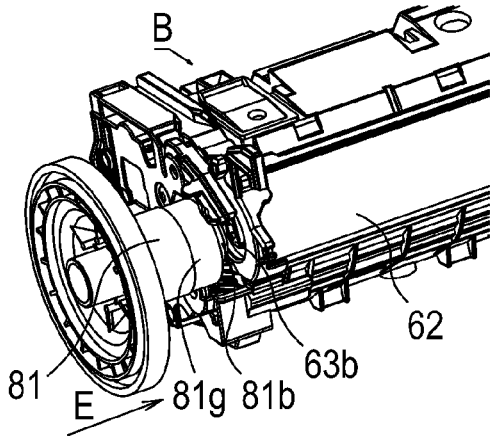
Figure 8D:
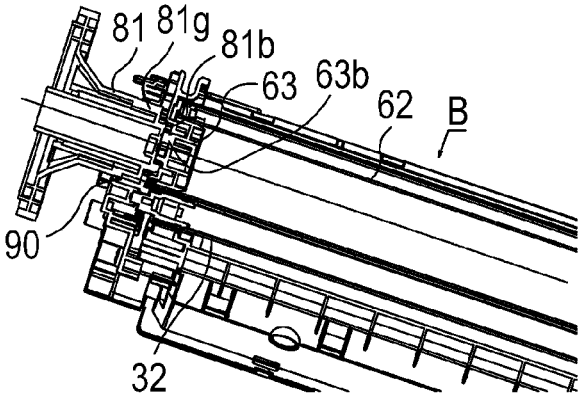

Referring to FIGS. 8A, 8B, 8C, and 8D, the configuration in which the cartridge B receives driving force from the apparatus main body A is now described. FIG. 8A is a diagram showing the configuration of a drive portion of the apparatus main body A. FIG. 8B is a diagram showing the configuration of a drive portion of the cartridge B. FIG. 8C is a diagram showing a state before the drive portions of the apparatus main body A and the cartridge B are engaged. FIG. 8D is a diagram showing a state in which the power of the apparatus main body A is turned on and the drive portions of the apparatus main body A and the cartridge B are engaged.

As shown in FIG. 8A, the apparatus main body A includes a drive transmission member 81, which receives driving force from a driving source (not shown) of the apparatus main body A and transmits the driving force to the cartridge B. As shown in FIG. 8B, the cartridge B includes a driven portion 63*b* in the drive-side drum flange 63 to engage with the drive transmission member 81 and receive the driving force. When the opening/closing door 13 is closed and the power of the apparatus main body A is turned on, the drive transmission member 81 moves in the direction of arrow E in FIG. 8C. Then, as shown in FIG. 8D, a drive transmission portion 81*b* of the drive transmission member 81 engages with the driven portion 63*b* of the drive-side drum flange 63, and the drum 62 is rotated through the drive-side drum flange 63. The outer circumference of the drive transmission member 81 has a gear shape 81*g*. Additionally, a developing roller gear 90 is coupled to an end of the developing roller 32 of the cartridge B. When the driven portion 63*b* of the drive-side drum flange 63 is engaged as shown in FIG. 8D, the gear shape 81*g* on the drive transmission member 81 and the developing roller gear 90 are arranged so as to mesh with each other. That is, when the drive transmission member 81 rotates the drum 62 through the drive-side drum flange, the developing roller 32 also rotates simultaneously through the developing roller gear 90.

Configuration of Developing Unit 20

Figure 9:
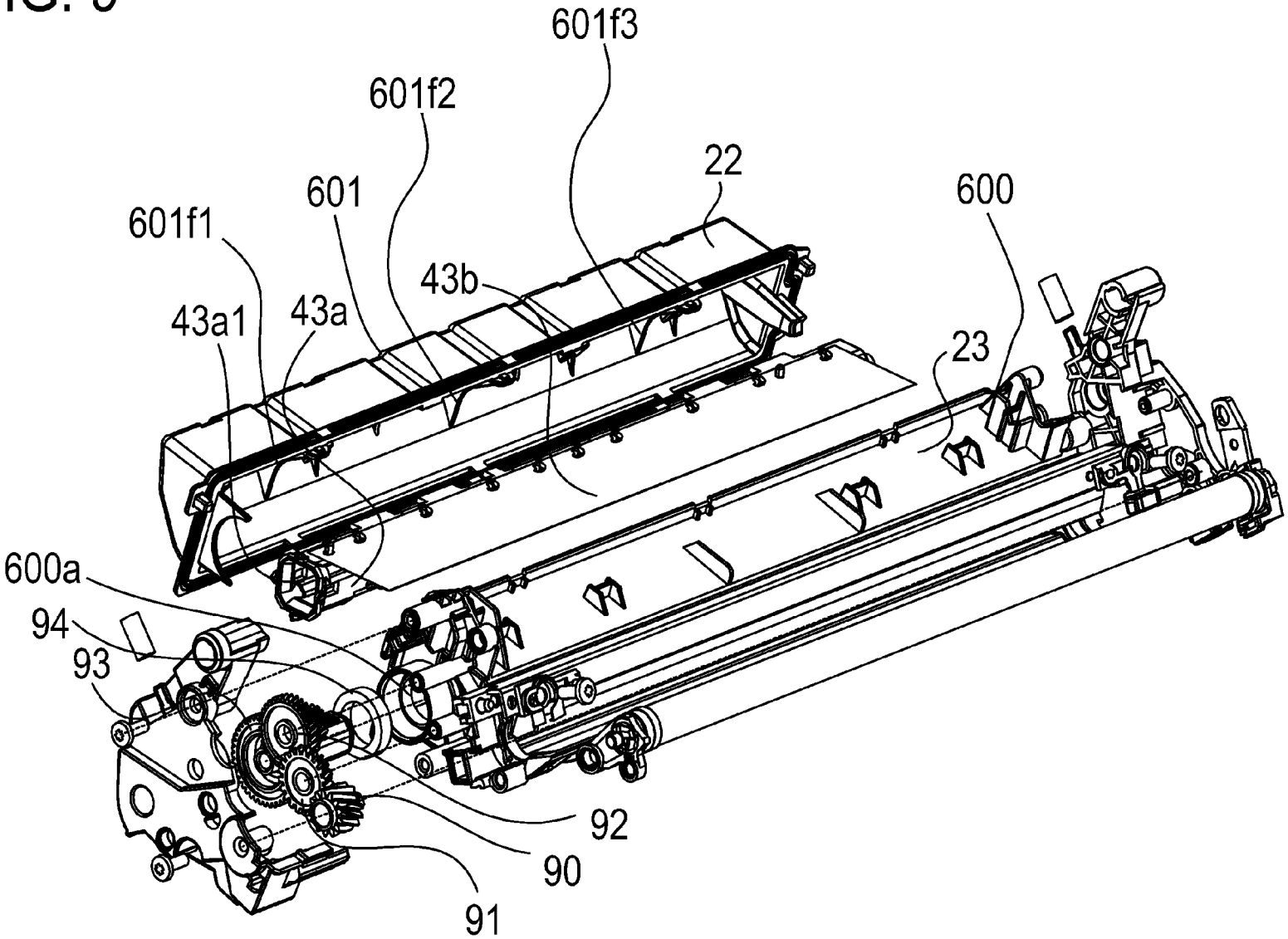
FIG. 9 is a perspective view illustrating the configuration of the developing unit.

Referring to FIG. 9, the configuration of the developing unit 20 is described in further detail. FIG. 9 is a perspective view illustrating the configuration of the developing unit 20.

As shown in FIG. 9, the developing container 600 is integrally joined, at a first opening 600*a*, with the lid 601, which is a first base member, by a joining member such as welding. The conveyance member 43 includes a shaft member 43*a* (support member) and a conveyance sheet member 43*b* (sheet) as a sheet member. The conveyance sheet member 43*b*, which is a flexible member, is fixed to the shaft member 43*a* by a fixing member such as snap fit, heat caulking, or double-sided tape. That is, the shaft member 43*a* supports the conveyance sheet member 43*b*. The shaft member 43*a* includes a drive opening 43*a*1 for driving input from the outside and a cylindrical supported portion (not shown). When the developing container 600 and the lid 601 are joined, the conveyance member 43 is placed within the developing container 600 and supported so as to be rotatable about a rotation axis A1 (rotation axis) and relative to the developing container 600. The lid 601 is located opposite to the developing roller 32 with respect to the conveyance member 43. As such, the capacity of the developing unit 20 can be changed simply by replacing the lid 601 with a smaller second base member 602 (see FIG. 13). This allows the assembly steps to be easily changed when the capacity of the developing container 600 varies among production lots. When the conveyance member 43 rotates about the rotation axis A1 of the conveyance member 43 and if the conveyance sheet member 43*b* maintains its natural state (natural length), the circle that is traced by the sheet distal edge portion 43*b*1 of the conveyance member 43 is referred to as a rotation path 43*r* of the conveyance member 43 (see FIG. 1). The "natural length" used herein refers to the distance (first distance) between the rotation axis A1 of the shaft member 43*a* and an edge of the conveyance sheet member 43*b* in a direction perpendicular to the rotation axis A1 in a state in which the conveyance sheet member 43*b* is unbent. That is, the circle (rotation path 43*r*) that is traced by the sheet distal edge portion 43*b*1 is an imaginary circle having a center on the rotation axis A1 and a radius of the first distance.

The drive-side end of the shaft member 43*a* has the drive opening 43*a*1, which faces the developing container 600. The developing container 600 has a hole 600*n* (see FIG. 9), which faces the drive opening 43*a*1. A conveyance gear 93 is inserted into the hole 600*n* from the outer side in the longitudinal direction of the developing container 600 and engages with the drive opening 43*a*1 inside the developing container 600. The conveyance gear 93 is connected to the developing roller gear 90 by a first idler gear 91 and a second idler gear 92 so as to be driven. The drive transmission member 81 drives the developing roller gear 90 to rotate the conveyance gear 93. The rotation of the conveyance gear 93 rotates the conveyance member 43. A conveyance sealing member 94 is compressed between the conveyance gear 93 and the developing container 600. The conveyance sealing member 94 is made of a material with sufficient cushioning characteristics and adhesiveness, such as urethane foam. The conveyance sealing member 94 is in close contact with the conveyance gear 93 and the developing container 600, thereby preventing the toner in the developing container 600 from leaking to the outside through the hole 600*n*.

Description of Developing Frame

Figure 10:
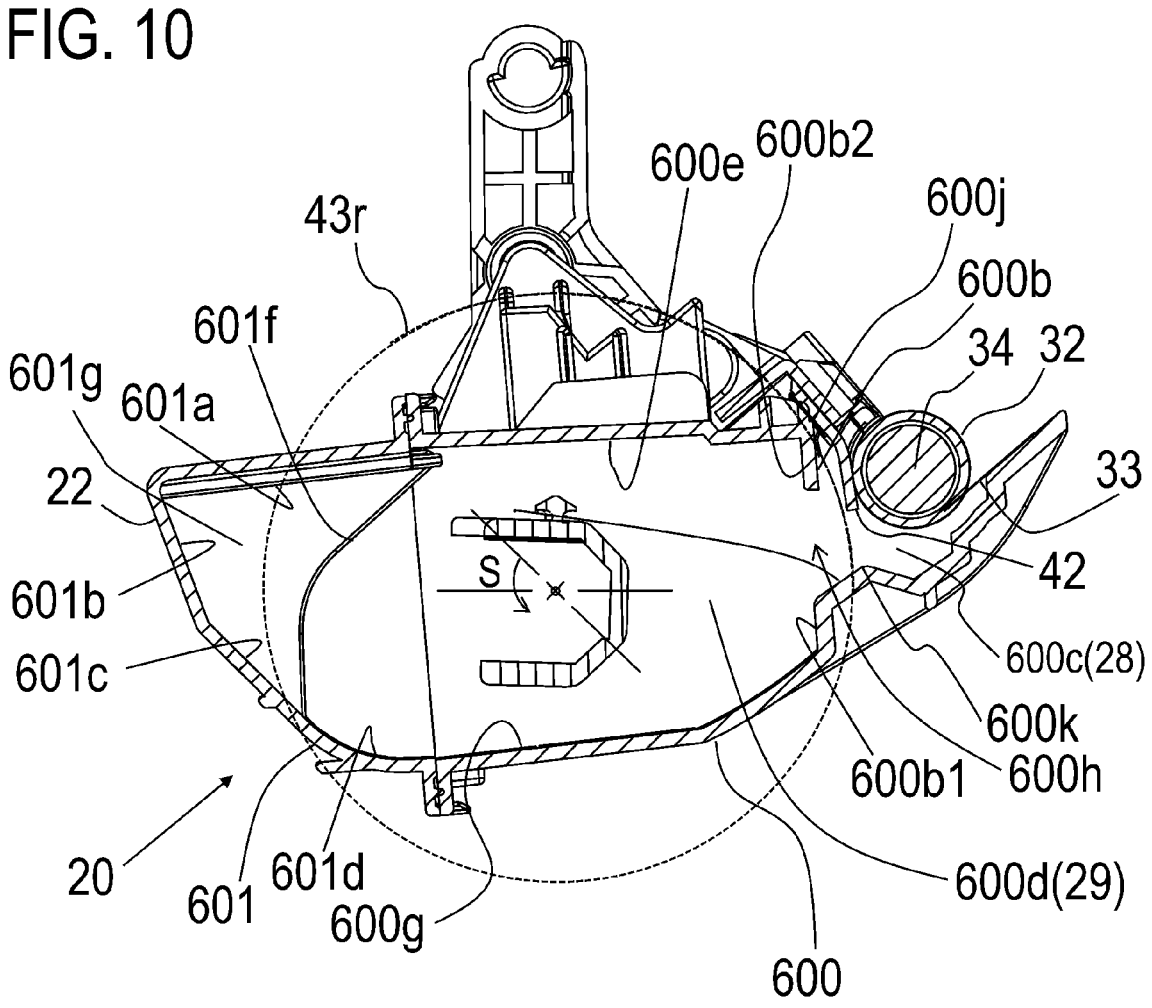
FIG. 10 is a cross-sectional view of the principal section of the developing unit.
Figure 11:
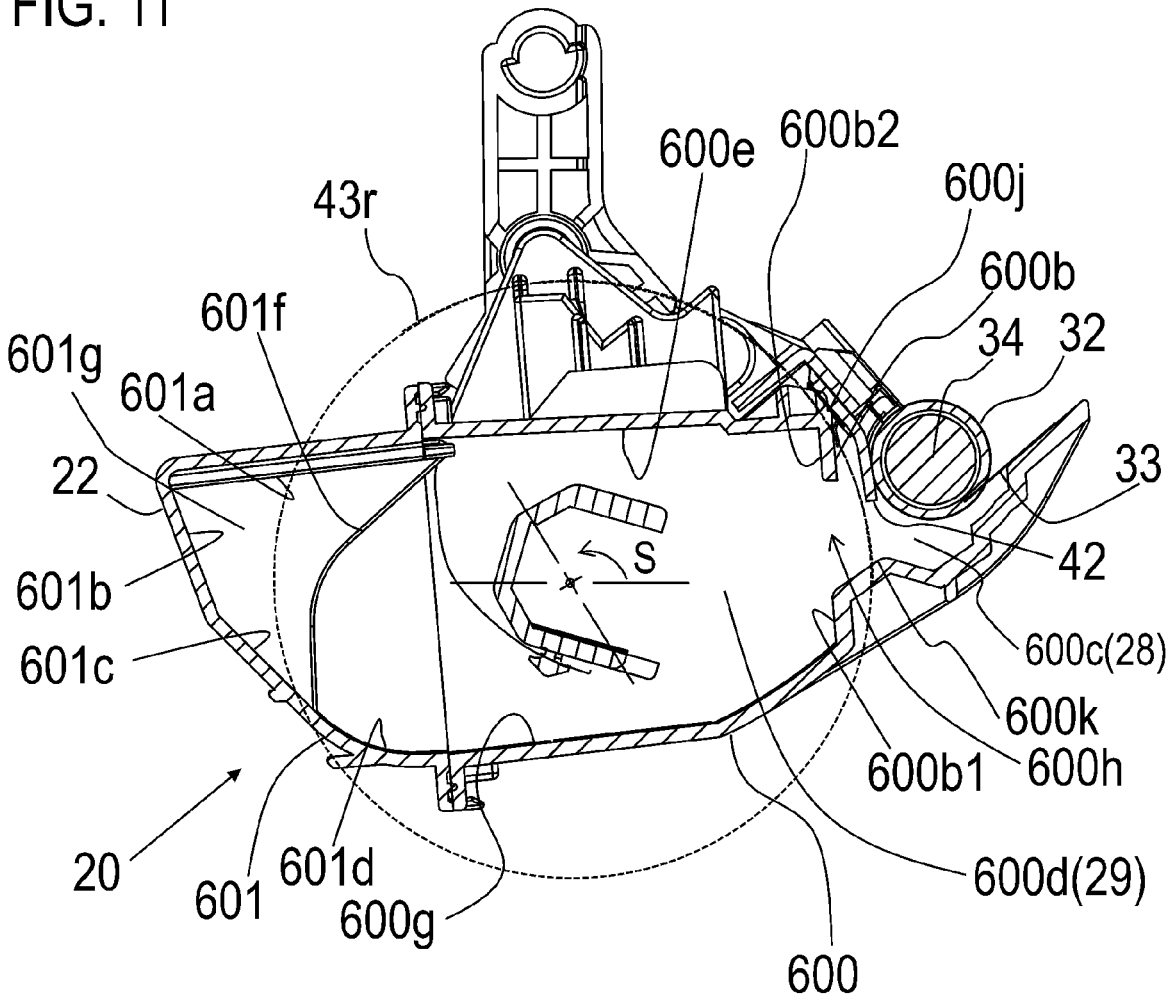
FIG. 11 is a cross-sectional view of the principal section of the developing unit.

Referring to FIGS. 1, 10, and 11, the configuration of the developing unit 20 is described in further detail. FIG. 1 is a cross-sectional view of the principal section of the developing unit 20 including the developing container 600. As shown in FIG. 1, the developing unit 20 stores toner T in the storage space defined by the developing container 600 and the lid 601. FIG. 10 is a cross-sectional view illustrating the support configuration of the conveyance member 43. FIG. 11 is a partial cross-sectional view of the drive-side end of the developing unit 20 as viewed from the non-drive side in the longitudinal direction.

As shown in FIG. 1, a developer sealing wall 600*b* divides the developing container 600 into a developing portion 600*c* and a developer storage portion 600*d*. The developer storage portion 600*d* includes the above-mentioned conveyance member 43, and is formed by the developer sealing wall 600*b*, an upper wall 600*e*, a first opening 600*a*, and a lower wall 600*g*. The developer sealing wall 600*b* has a second opening 600*h*, which provides communication between the developer storage portion 600*d* and the developing portion 600*c*. The conveyance member 43 conveys toner T to the developing portion 600*c* through the second opening 600*h*. The section of the developer sealing wall 600*b* located below the second opening 600*h* is referred to as a lower sealing wall 600*b*1, and the section above the second opening 600*h* is referred to as an upper sealing wall 600*b*2.

The developing portion 600*c* includes the developing roller 32, the developing blade 42, a developing blade back seal 600*j*, and a developing roller lower sheet 602. The developing roller 32 faces the second opening 600*h*. That is, the conveyance member 43 conveys the toner T toward the developing roller 32 through the second opening 600*h*. This configuration allows the toner T conveyed to the developing portion 600*c* to be carried on the developing roller 32 with a constant layer thickness as the developing roller 32 rotates. Additionally, the configuration limits leakage of the toner T from the developing portion 600*c*. An inclined portion 600*k* is formed between the second opening 600*h* and the developing roller 32. The inclined portion 600*k* is continuous with the lower sealing wall 600*b*1. The developing blade back seal 600*j* and the inclined portion 600*k* are parts of the developing container 600, while the developing blade 42 and the developing roller lower sheet 602 are directly fixed to the developing container 600 (not shown).

The lid 601 is fixed to the developing container 600 at the first opening 600*a* of the developing container 600. The lid 601 includes an upper wall 601*a*, a first inclined surface 601*b*, a second inclined surface 601*c*, and a concave arcuate wall 601*d* (arcuate surface). The first and second inclined surfaces 601*b* and 601*c* each form, with a horizontal plane, an angle that allows the toner T to fall under its own weight (the angle of repose) or greater (an angle greater than or equal to the angle of repose). The arcuate wall 601*d* is continuous with the lower wall 600*g*, which is the base surface of the developing container 600. The lid 601 further includes ribs 601*f* extending across the upper wall 601*a* and the first and second inclined surfaces 601*b* and 601*c*. The ribs 601*f* serve as contact portions configured to come into contact with the conveyance sheet member 43*b*. Each rib 601*f* extends across the first and second inclined surfaces 601*b* and 601*c* and along a plane perpendicular to the rotation axis. The ribs 601*f* are provided at intervals in the longitudinal direction (ribs 601*f*1 to 601*f*3, see FIG. 9).

The relationship between the above-mentioned components and the rotation path 43*r* of the conveyance member 43 is now described. As shown in FIG. 1, a part of the inclined portion 600*k* in the developing portion 600*c* is at the inner side of the rotation path 43*r*. The inclined portion 600*k* faces toward the rotation center A1 of the conveyance member 43. The inclined portion 600*k* is an inclined surface extending from the lower edge of the second opening 600*h* such that the distance from the rotation center A1 (rotation axis) of the conveyance member 43 gradually increases from the upstream side to the downstream side in the rotation direction S of the conveyance member 43. The lid 601 includes a region (corner portion 601*g*) that extends the toner storage space outward of the rotation path 43*r*. Of the space defined by the upper wall 601*a*, the first inclined surface 601*b*, and the second inclined surface 601*c*, the corner portion 601*g* defines a space that is outside the rotation path 43*r*. The ribs 601*f* located in this corner portion 601*g* each have the shape of a rib protruding to the inner side of the rotation path 43*r*. Each rib 601*f* is formed so that the distance from the rotation center A1 increases from the upstream side to the downstream side in the rotation direction S.

According to the configuration described above, the inclined portion 600*k* faces toward the rotation center A1, and the distance between the inclined portion 600*k* and the rotation center A1 increases in the rotation direction S. Consequently, the conveyance sheet member 43*b* is gradually released from bending while in contact with the inclined portion 600*k* (see also FIG. 10). The allows the toner T on the inclined portion 600*k* to be conveyed in the direction of the developing roller 32, achieving the efficient use of the toner T in the developing portion 600*c*. Also, the bending of the conveyance sheet member 43*b* is released gradually, reducing the noise (release noise) generated when the conveyance sheet member 43*b* is released from a bent state.

Furthermore, the lid 601 includes the corner portion 601*g*, which is outside the rotation path 43*r*, allowing the toner T to be stored outward of the rotation path 43*r*. The developing unit 20 can thus have a larger capacity.

Moreover, the ribs 601*f*, which protrude into the inner side of the rotation path 43*r*, are located in the corner portion 601*g*. As such, the conveyance member 43 rotates with its distal edge portion 43*b*1 constantly in contact with the developing container 600 or the lid 601 except when the distal edge portion 43*b*1 reaches the developing portion 600*c* (see also FIG. 11). This reduces the occasions in which the conveyance sheet member 43*b* is released from a bent state, thereby reducing the release noise. The configuration also reduces the fatigue fracture, which would otherwise occur due to repeated bending and releasing of the conveyance sheet member 43*b*.

Each rib 601*f* is shaped such that the distance from the rotation center A1 increases in the rotation direction S. As such, when the conveyance sheet member 43*b* moves from the upper wall 600*e* and along the ribs 601*f*, the bending of the conveyance sheet member 43*b* is gradually released without fluctuations. This reduces the occasions in which the conveyance sheet member 43*b* is released, further limiting the generation of release noise and fatigue fracture. The ribs 601*f* are located in a region having an angle greater than or equal to the angle of repose in the inner surface of the corner portion 601*g* forming the storage space. The arcuate wall 601*d*, which has an angle less than the angle of repose, does not have a rib. This allows the conveyance sheet member 43*b* to come into contact with the arcuate wall 601*d* and thus convey the toner T on the arcuate wall 601*d*.

Other Embodiments

Figure 12:
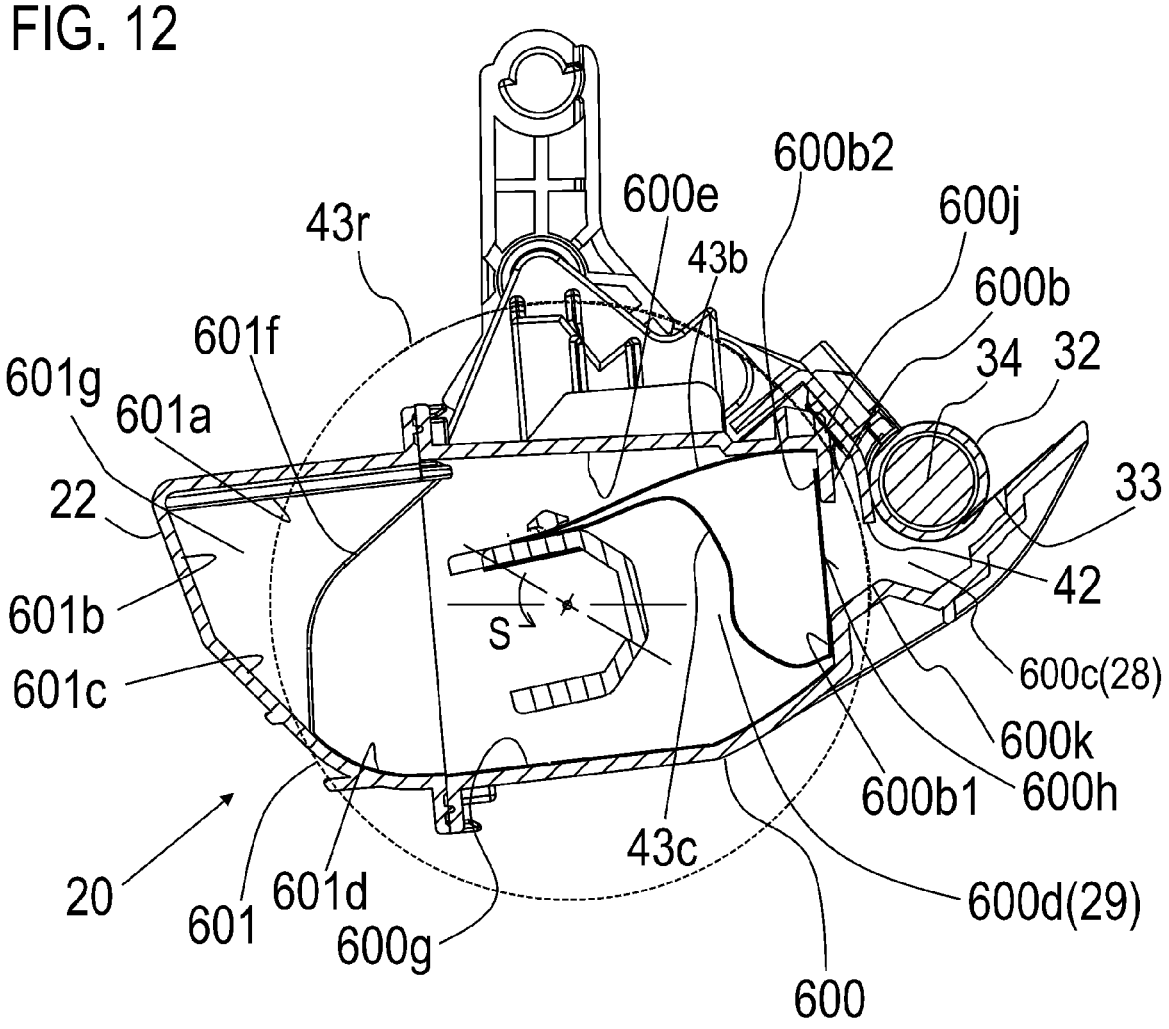
FIG. 12 is a cross-sectional view of the principal section of a developing unit.

As shown in FIG. 12, the conveyance member 43 may include a second sheet member 43*c*, which may be fixed to the developer sealing wall 600*b* by heat welding or other means. The second sheet member 43*c* may be fixed to the developer sealing wall 600*b* with a fixing force that allows the second sheet member 43*c* to be peeled off from the developer sealing wall 600*b* when the conveyance member 43 rotates at the beginning of use of the cartridge B, thereby opening the second opening 600*h*. As such, when the cartridge B is unused, the developer sealing wall 600*b* and the second sheet member 43*c* separate the developer storage portion 600*d* from the developing portion 600*c* to prevent leakage of the toner T during its distribution and storage.

Figure 13:
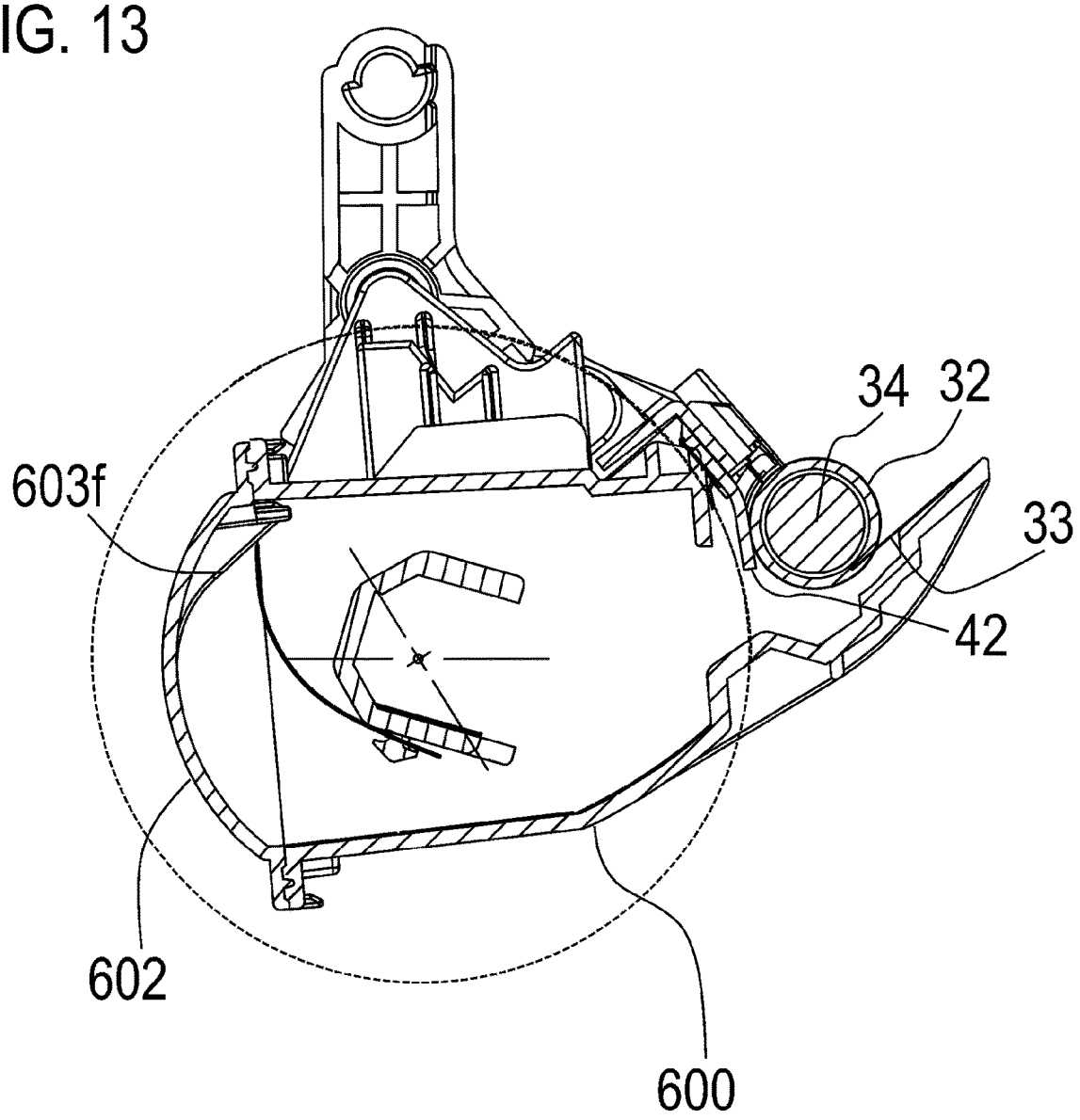
FIG. 13 is a cross-sectional view of the principal section of a developing unit.

FIG. 13 shows another embodiment in which the lid 601 is replaced with a second base member 603 including ribs 603*f* that extend along planes perpendicular to the rotation axis of the conveyance member 43 and are configured to come in contact with the conveyance sheet member 43*b* as contact portions. The second base member is shaped so that the inner surface defining the toner storage space is located inside the rotation path of the conveyance member 43. As such, the amount of toner T stored in the developing unit 20 can be changed. Each rib 603*f* is shaped such that the distance from the rotation center A1 gradually increases from the upstream side to the downstream side in the rotation direction S, thereby reducing the occasions in which the conveyance sheet member 43*b* is released.

This embodiment reduces the fatigue of the conveyance sheet member 43*b* in the developing apparatus whose storage capacity for developer can be changed simply by replacing the base member. This embodiment also reduces the release noise of the conveyance sheet member 43*b*. Furthermore, the toner T in the developing portion 600*c* is used efficiently.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-102663, filed on Jun. 12, 2020, which is hereby incorporated by reference herein in its entirety.

What is claimed is:

1. A developing apparatus comprising:

a developing container having a first opening and a second opening;

a lid fixed to the developing container so as to close the first opening, the lid defining, together with the developing container, a storage space for developer;

a developing roller provided so as to face the second opening; and a conveyance member configured to convey the developer toward the developing roller through the second opening in the developing container, the conveyance member including a flexible sheet and a support member that supports the flexible sheet and that is rotatable about a rotation axis together with the sheet, the flexible sheet having a first distance between the rotation axis and an edge of the flexible sheet in a direction orthogonal to the rotation axis in a state where the flexible sheet is unbent, wherein the lid includes:

a corner portion that, as viewed in a direction along the rotation axis, extends the storage space outward of an imaginary circle with a radius of the first distance centered on the rotational axis; and a contact portion which protrudes from an inner surface of the corner portion to an inner side of the imaginary circle and with which the flexible sheet is configured to contact while the conveyance member is being rotated, the contact portion having a distal edge that is shaped such that a distance between the distal edge and the rotation axis increases toward a downstream side in a rotation direction of the conveyance member as viewed in the direction along the rotation axis.

2. The developing apparatus according to claim 1, wherein, as viewed in the direction along the rotation axis, an inner surface the corner portion of the lid has a concave arcuate surface located below a region that includes the contact portion in a state where the developing apparatus is in an apparatus body of an image forming apparatus, and wherein the arcuate surface is continuous with a bottom surface of an inner surface of the developing container defining the storage space in the state where the developing apparatus is in an apparatus body of an image forming apparatus.

3. The developing apparatus according to claim 1, wherein, as viewed in the direction along the rotation axis, an inner surface of the developing container defining the storage space is located at the inner side of the imaginary circle.

4. The developing apparatus according to claim 1, wherein the contact portion is one of a plurality of ribs, the plurality of ribs each extending in a direction perpendicular to the rotation axis, and wherein the plurality of ribs are spaced apart in the direction along the rotation axis.

5. The developing apparatus according to claim 1, wherein the developing roller is located opposite to the conveyance member across the second opening.

6. The developing apparatus according to claim 1, wherein a part of a sealing member that seals the second opening is fixed to the conveyance member in a state where the developing apparatus is brand-new, and the conveyance member is configured to rotate to peel off the sealing member from the second opening to open the second opening.

7. The developing apparatus according to claim 1, wherein in a state where the developing apparatus is in an apparatus body of an image forming apparatus, an inner surface of the developing container has a bottom surface below the conveyance member, and wherein the inner surface of the corner portion of the lid has a region which slopes downward toward the bottom surface of the developing container as viewed in the direction along the rotation axis.

8. The developing apparatus according to claim 1, wherein the conveyance member is arranged between the first opening and the second opening of the developing container.

9. The developing apparatus according to claim 1, wherein the developing apparatus is a cartridge detachably attached to the apparatus body of the image forming apparatus.

* * * * *